United States Patent [19]

Otto et al.

[11] 4,106,593

[45] Aug. 15, 1978

[54] METHODS AND TOOLS FOR SERVICING AN ELEVATOR SYSTEM

[75] Inventors: Paul R. Otto, Marlboro, N.J.; Alan F. Mandel, Pittsburgh, Pa.

[73] Assignee: Westinghouse Electric Corp., Pittsburgh, Pa.

[21] Appl. No.: 778,831

[22] Filed: Mar. 17, 1977

[51] Int. Cl.[2] ..... B66B 3/00

[52] U.S. Cl. ..... 187/29 R; 340/19 R

[58] Field of Search ..... 187/29; 340/19–21

[56] References Cited

U.S. PATENT DOCUMENTS

| | | | |
|---|---|---|---|
| 3,740,709 | 6/1973 | Savino | 340/21 |
| 3,973,648 | 8/1976 | Hummert et al. | 187/29 R |
| 4,002,973 | 1/1977 | Wiesendanger et al. | 187/29 R X |

*Primary Examiner*—James R. Scott
*Assistant Examiner*—W. E. Duncanson, Jr.
*Attorney, Agent, or Firm*—D. R. Lackey

[57] ABSTRACT

Apparatus and methods for servicing an elevator system having a plurality of elevator cars under the supervision of a supervisory system processor. The system processor makes assignments to the cars according to a predetermined strategy. The servicing tool is connectable to the elevator system such that the positions of the cars in the building, the assignments to the cars by the system processor, and the status of the elevator cars, are displayed on a panel position and motion indicator or display. The servicing tool also includes pushbuttons for entering car and hall calls, and a mode select switch. The mode select switch includes an operating mode in which the system processor is maintained operational, and the controls of the cars are maintained operational, except the cars are inhibited from moving. The servicing method includes inhibiting the cars from moving while predetermined calls are entered into the system. The assignments to the cars, the change in assignments, and the change in the status of the cars as each call is entered, are noted by viewing the display. The display image, after each call is entered, may be compared with the correct image or response of the system processor and cars, to quickly check the system processor and car controllers to determine if they are operating properly.

20 Claims, 6 Drawing Figures

METHODS AND TOOLS FOR SERVICING AN ELEVATOR SYSTEM

BACKGROUND OF THE INVENTION

1. Field of the Invention

The invention relates in general to elevator systems which include a plurality of elevator cars and a supervisory system processor for directing their activity, and more specifically to new and improved methods and apparatus for servicing such elevator systems.

2. Description of the Prior Art

Elevator systems having a plurality of elevator cars require some sort of supervisory control system, or all of the cars may attempt to answer a hall call when it is registered. The supervisory control system obtains information from the plurality of elevator cars relative to their positions and status, and assigns the currently existing work load, i.e., calls for elevator service, to the various cars according to a predetermined strategy built into the system processor.

Each building is unique from the standpoint of the number of floors, the population per floor, the nature of the up peak when the building is populated, the nature of the down peak when it is de-populated, and the nature of interfloor traffic. Each building is also unique in the number of basement floors, top-extension floors, special floors, such as convention floors, restaurant floors, and the like. In order to provide optimum elevator service for a building, all of the above-mentioned factors are taken into account when the number of elevator cars is initially selected for the building, and the specific strategy to be utilized by the system processor may be tailored for the building by adding certain optional features to a basic operating strategy.

If an elevator car goes completely out of service for some reason, this fact will be quickly noticed and the problem corrected by maintenance personnel. On the other hand, malfunctions which degrade the quality of elevator service, without completely disrupting it, are difficult to spot and may go unnoticed for long periods of time. The strategy of the system processor, when periodically checked, or when it is checked to pinpoint the cause of service degradation, would require dispersing maintenance personnel throughout the building to enter cells, and the responses of the cars to the calls would then be noted and timed with a stopwatch in an attempt to detect a malfunction in the supervisory system processor and/or in the car controllers of the individual cars.

U.S. Pat. No. 3,740,709, which is assigned to the same assignee as the present application, illustrates a panel position and motion indicator which selectively indicates the status of a plurality of elevator banks. This panel is for viewing only. It includes no provisions for entering commands, and no provisions for use as a servicing and maintenance tool.

Application Ser. No. 510,940, filed Sept. 30, 1974, which is assigned to the same assignee as the present application, discloses an interactive, real time elevator bank simulation system which facilitates the development and testing of new strategy. U.S. Pat. No. 3,973,648, which is also assigned to the same assignee as the present application, discloses a monitoring system for off-site monitoring, traffic study and/or troubleshooting of elevator installations, which system utilizes the interactive display panel of Application Ser. No. 510,940. U.S. Pat. No. 3,973,648 describes a monitoring system which enables communication to be established with an elevator system via a communication link, and the operation of the elevator system monitored on a display. Commands, such as car and hall calls, may be entered via appropriate pushbuttons on the display panel, and the response to the commands viewed on the display. This is a significant advance in the art of servicing elevator systems, as an elevator system may be monitored and exercised remotely. It would also be desirable to improve on-site maintenance and servicing procedures.

SUMMARY OF THE INVENTION

The present invention includes new and improved apparatus and methods for servicing elevator systems, which enables the strategy of the supervisory system processor, and the car controllers of the elevator cars, to be rapidly and efficiently checked. While the invention is especially advantageous for on-site servicing, certain teachings of the invention may be incorporated into the off-site monitoring system of U.S. Pat. No. 3,973,648, to improve its diagnostic value. The present invention is especially suitable for servicing elevator systems in which the car calls and hall calls are serialized for transmission between the various control elements of the system, and the invention will be described in this context.

More specifically, the present invention includes an interactive panel position and motion indicator which is compact and portable, and thus may be easily carried from site to site. It is easily connectable to an elevator system initially constructed to cooperate with such a servicing tool, and it utilizes the existing data links between the elevator cars and supervisory system processor. The panel includes pushbuttons for entering car and hall calls, and the calls entered on these pushbuttons are stored in storage means located separately from the storage means associated with the conventionally entered calls. The calls are serialized and wire OR'ed with the appropriate serial call lines of the elevator system being serviced. Thus, the maintenance and servicing panel does not depend upon operability of the call circuits in the elevator system being serviced.

The panel further includes a mode select switch which includes a car inhibit mode which inhibits the elevator cars from moving. This car inhibit mode, however, does not prevent the elevator cars from "seeing" assignments made by the system processor, or hall calls associated with the assignments. Further, the car inhibit mode does not prevent the elevator cars from providing status signals, such as signals which indicate the position of the car, the fact that the car is in-service, the travel direction, and other responses to assignments and calls, up to the point of actually moving to serve a call. The supervisory system processor is maintained completely operational. The supervisory system processor may thus be quickly checked to determine if all of the strategy features associated therewith are operational. For example, each elevator car may be sent to a specific floor of the building by entering car calls on the panel which cause the cars to travel to the desired floors. Once the cars have arrived at the floors and have stopped, opened their doors for a predetermined period of time, and then closed their doors to become "available", the mode select switch is changed to select the car inhibit mode. Now, predetermined calls may be entered into the system, and the response of the system to each call observed. The system processor may be checked by observing the assignments it makes and/or changes in assignments, after each call is placed, and the individual car control for each car may be checked by observing its status signals responsive to each assignment, and each assignment change. Each strategy feature may be checked by giving maintenance personnel a call sequence to be entered for checking each strategy feature, and comparison charts which present the proper appearance of the display panel after entry of each call may also be provided for quick comparison with the display panel.

BRIEF DESCRIPTION OF THE DRAWING

The invention may be better understood, and further advantages and uses thereof more readily apparent, when considered in view of the following detailed description of exemplary embodiments, taken with the accompanying drawings in which.

DESCRIPTION OF PREFERRED EMBODIMENTS

Figure 1:
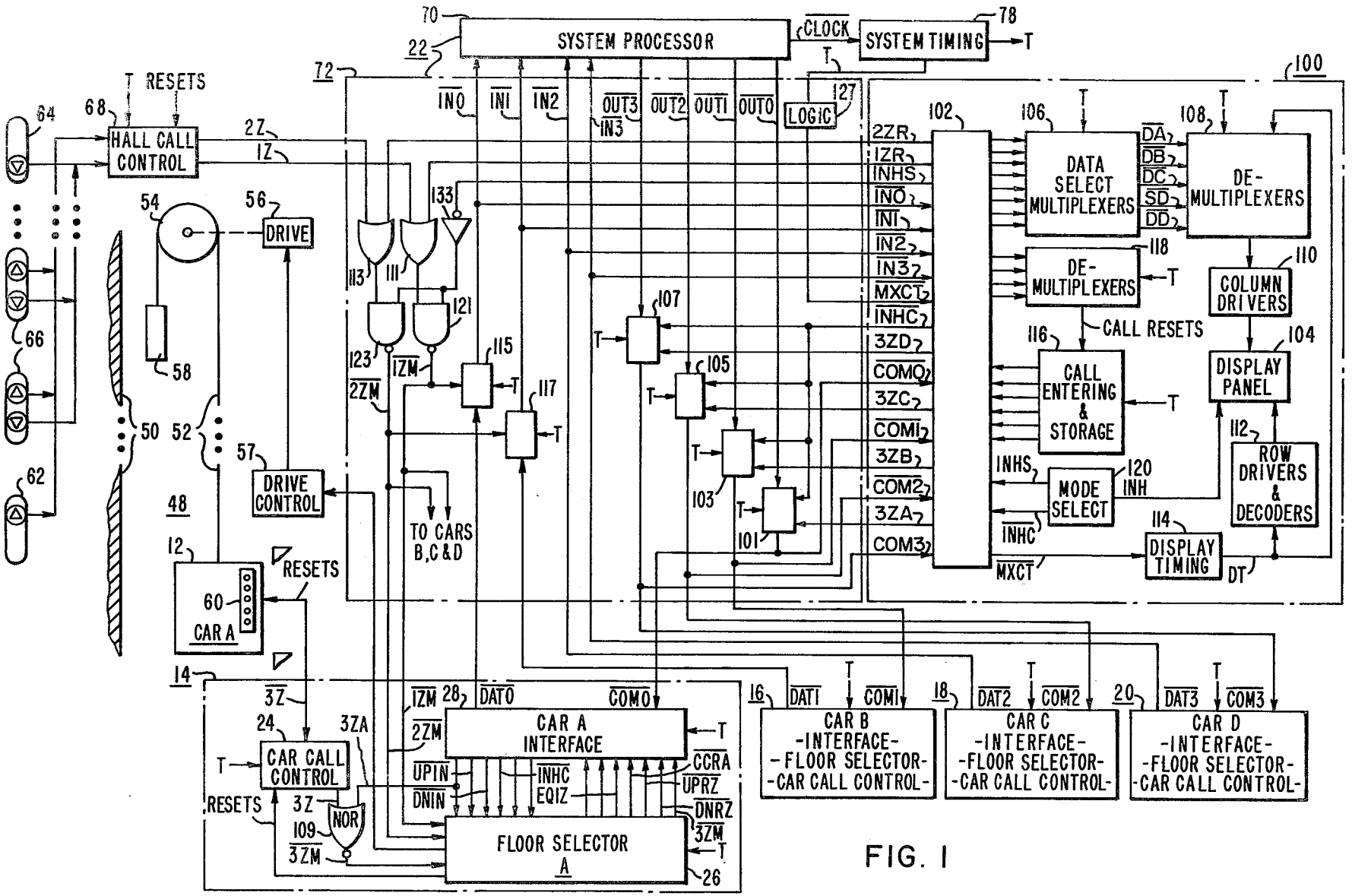
FIG. 1 is a schematic diagram of an elevator system constructed according to the teachings of the invention.

Referring now to the drawings, and FIG. 1 in particular, there is shown an elevator system 10 constructed according to the teachings of the invention. Elevator system 10 includes a bank of elevator cars, with the controls 14, 16, 18 and 20 for four cars being illustrated for purposes of example. Only a single car 12 is illustrated, associated with car call control 14, in order to simplify the drawing, since the remaining cars would be similar. Each car control includes a car call control function, a floor selector function, and an interface function for interfacing with supervisory system control 22. The supervisory system control 22 controls the operating strategy of the elevator system as the elevator cars go about the business of answering hall calls. For purposes of example, it will be assumed that the supervisory system control is the control described in detail in application Ser. No. 574,662, filed May 5, 1975, now U.S. Pat. No. 4,046,227, which is assigned to the same assignee as the present application.

Car controller 14 includes car call control 24, a floor selector 26, and an interface circuit 28. For purposes of example, it will be assumed that the floor selector 26 is the floor selector described in detail in U.S. Pat. Nos. 3,750,850 and 3,804,209, both of which are assigned to the same assignee as the present application. Application Ser. No. 574,662 and U.S. Pat. Nos. 3,750,850 and 3,804,209 are hereby incorporated into the present application by reference.

Car 12 is mounted in a hatchway 48 for movement relative to a building 50 having a plurality of floors or landings, with only a few floors being illustrated in order to simplify the drawing. The car 12 is supported by a rope 52 which is reeved over a traction sheave 54 mounted on the shaft of a suitable drive motor 56. Drive motor 56 is controlled by suitable drive control 57. A counterweight 58 is connected to the other end of the rope 52.

Car calls, as registered by pushbutton array 60 mounted in the car 12, are recorded and serialized in the car call control 24, and the resulting serialized car call information is directed to the floor selector 26.

Hall calls, as registered by pushbuttons mounted in the hallways, such as the up pushbutton 62 mounted at the bottom landing, the down pushbutton 64 located at the uppermost landing, and the up and down pushbuttons 66 located at the intermediate landings, are recorded and serialized in hall call control 68. The resulting serialized hall call information is directed to the floor selectors of all of the elevator cars, as well as the supervisory system control 22.

The floor selector 26 keeps track of the elevator car 12 and the calls for service for the car, and provides signals for the drive control 57. The floor selector 26 also provides status signals for the supervisory system controller 22, and signals for controlling such auxiliary devices as the door operator and hall lanterns. It also provides signals for resetting its own car calls, and signals for resetting hall calls which the car answers.

The supervisory system control 22 includes a processing function 70 and an interface function 72. The processing function 70 receives car status signals from each of the car controllers via the interface function 72, as well as the up and down hall calls, and it provides assignment words for each car controller which cause the elevator cars to serve the calls for elevator service according to a predetermined strategy. The car status signals provide information for the processing function 70 relative to what each car can do in the way of serving the various floors, and the processing function 70 makes assignments to the cars based on this car supplied information.

The supervisory system control 22 provides a timing signal $\overline{\text{CLOCK}}$ for synchronizing a system timing function 78. The system timing function 78 provides timing signals for controlling the flow of data between the various control functions of the elevator system. The elevator system 10 is basically a serial, time multiplexed system, and the timing function 78 generates the timing signals necessary to present data in the proper timed relationship. Each floor of the building to be serviced is assigned its own time or scan slot in each time cycle, and thus the number of time slots in a time cycle is dictated by the number of floors in the associated building. Each floor has a different scan slot associated therewith, but it is not necessary that every scan slot be assigned to a floor level. Scan slots are generated in cycles of 16, 32, 64 or 128, with the specific cycle selected being such that there will be at least as many scan slots available as there are floor levels. For purposes of example, it will be assumed that there are 16 floors in the building, so the cycle with 16 scan slots will be sufficient.

The 16 scan slot cycle is generated by a binary counter which, as described in the incorporated patents, would have outputs S0S, S1S, S2S, and S3S for a 16 scan slot system. The binary address of scan slot is 00 is 0000, the binary address of scan slot 01 is 0001, etc.

The system processor 70 is preferably a programmable system processor, such as the microprocessor shown in detail in the incorporated application. The system processor includes outputs for serially sending commands to each elevator car, with these output commands or signals being referenced $\overline{OUT0}$, $\overline{OUT1}$, $\overline{OUT2}$ and $\overline{OUT3}$ for cars, A, B, C and D, respectively.

The system processor 70, for example, sends commands $\overline{SUT}$, $\overline{SDT}$, $\overline{DOPN}$, $\overline{NEXT}$, $\overline{PKFL}$, $\overline{UPIN}$, and $\overline{DNIN}$, to each elevator car. The commands which are not floor related are contained in the first quarter of each scan slot. For example, the command signal $\overline{SUT}$, which requests that the floor selector of the car be set for up travel, may be sent during scan slot 00; the command $\overline{SDT}$, which requests that the floor selector of the car be set for down travel, may be sent during slot 01; the command $\overline{DOPN}$ which requests a car to open its doors, may be sent during scan slot 02; and the command $\overline{NEXT}$, which notifies a car that it is to be the next car to leave the main floor, may be sent during scan slot 03.

The floor related signals $\overline{PKFL}$, $\overline{UPIN}$ and $\overline{DNIN}$ may be sent during any scan slot associated with a floor which the elevator car is enabled to serve. A true signal $\overline{PKFL}$ is sent to a car when the system processor 22 gives the car a command to park at a specific floor, with the signal appearing in the second quarter of the scan slot associated with the floor at which the car is to park. A true signal $\overline{UPIN}$ is sent to the floor selector of a car for each of those floors which the elevator car is capable of providing up service from, but which the system control wishes to block up hall calls registered therefrom from being considered by the car. In like manner, a true signal $\overline{DNIN}$ is sent to a car for each of those floors which the elevator car is capable of providing down service from, but which the system controller 22 wishes to block down hall calls registered therefrom from being considered by the car. Thus, to assign a down call from floor 6 to car A, for example, the supervisory control 22 would send true $\overline{DNIN}$ signals to cars B, C and D in the fourth quarter of scan slot 05, which scan slot is associated with floor position 6.

Each of the four elevator cars sends its status signals to the system processor 70 of the supervisory system control 22 via the interface 72. The status signals from each car are serialized by multiplexers located in the associated car interface, such as interface 28 for car A. These serial signals from elevator cars A, B, C and D are indicated by symbols $\overline{DAT0}$, $\overline{DAT1}$, $\overline{DAT2}$, and $\overline{DAT3}$, respectively. For example, floor selector 26 provides status signals AVP0-AVP3, INSC, BYPS, UPTR, $\overline{AVAS}$, $\overline{MDCL}$, and $\overline{CALL}$. Up and down floor enable signals $\overline{MTO0}$ and $\overline{MTO1}$, up and down hall call reset signals $\overline{UPRZ}$ AND $\overline{DNRZ}$, respectively, and serialized car calls $\overline{3Z}$, are also sent from each floor selector to the system processor 22. Signal EQ1Z is the serial car position signal. Signals AVP0-AVP3 provide the binary address of the floor at which a stationary car is standing, and when the car is moving it provides the binary address of the closest floor at which the car could make a normal stop. Signal INSC is true when the car is in-service with the system control 22. Signal BYPS is true when the car is set to bypass hall calls. For example, when a down traveling car becomes loaded, it will bypass hall calls on its way to the main floor. Also, when a car at the main floor becomes loaded, it will bypass up hall calls. In both situations, the car will issue a true BYPS signal. Signal UPTR is high or true when the car is set for up travel, and low when the car is set for down travel. Signal $\overline{AVAS}$ is true or low when the car is in-service, it has answered all of its calls, and it is standing at a floor with its doors closed. Thus, any NEXT car, which normally stands at the main floor with its door open and with its up hall lantern lit, is not considered an AVAS or available car. Signal $\overline{MDCL}$ is true when the car doors are closed, and signal $\overline{CALL}$ is true when the elevator car has a car call registered. Signals $\overline{MTO0}$ and $\overline{MTO1}$ are serial signals which may be provided by a read-only memory track in the car control 14, and they are true in the scan slots associated with the floors which the car is enabled to serve calls for service in the up and down directions, respectively. Signals $\overline{UPRZ}$ and $\overline{DNRZ}$ will go true in a scan slot associated with a floor being served by the car, when the car is serving an up or down hall call, respectively. Signal $\overline{3Z}$ is a serial, floor related signal which is true during the scan slots associated with the floors for which the car has registered car calls.

The up and down hall calls are each serialized in the hall call control 68, with the serial up and down hall calls being referred to as $\overline{1Z}$ and $\overline{2Z}$, respectively. The serial signals $\overline{DAT0}$, $\overline{DAT1}$, $\overline{DAT2}$, $\overline{DAT3}$, $\overline{1Z}$ and $\overline{2Z}$ are all applied to interface 72. The up hall calls $\overline{1Z}$ and the down hall calls $\overline{2Z}$ are combined with the status signals $\overline{DAT0}$ and $\overline{DAT1}$, respectively, in interface 72.

FIG. 1 illustrates a new and improved maintenance and servicing tool 100, which will be referred to as display 100. Display 100 may be connected to the interface 72 of the elevator system 10 for monitoring the operation of the elevator system, for interacting in real time with the elevator system 10 by initiating calls for elevator service, and for selecting predetermined operating modes which enable new and improved servicing methods to be utilized.

In general, display 100 includes a connector 102 for plugging the display 100 into the interface 72, a display panel 104 of illuminable devices, such as light emitting diodes (LED's), control associated with the display panel 104 such as data select multiplexers 106, demultiplexers 108, column drivers 110, row drivers and decoders 112, and a display timing function 114. Timing function 114 provides a plurality of display timing signals DT in response to a timing signal $\overline{MXCT}$. Timing signal $\overline{MXCT}$ is prepared in a logic circuit 127 in interface 72 in response to certain of the timing signals T provided by system timing 78. Signal $\overline{MXCT}$ is true during the last scan slot of each time cycle.

Display 100 also in includes a call entry and storage function 116, demultiplexers 118 for providing call resets for function 116, and a mode select function 120.

Call entering the storage 116 enables car calls 3ZA, 3ZB, 3ZC and 3ZD to be entered, stored and serialized for cars A, B, C and D, respectively. These serialized car calls are sent to interface 72 and multiplexed into the serialized per car commands for cars, A, B, C and D from the processor 70 via multiplexers 101, 103, 105 and 107, respectively. The serialized car calls from car A, for example, are combined in command word $\overline{COMO}$ and OR'ed with the serialized car cells 3Z from the car call control 24 in NOR gate 109, providing a combined serialized car call signal $\overline{3ZM}$ which is sent to the system processor as part of the car status word $\overline{DAT0}$.

Call entry and storage 116 also enables up and down hall calls 1ZR and 2ZR, respectively, to be entered, stored and serialized. These serialized hall calls are OR'ed with the up and down hall calls 1Z and 2Z in OR gates 111 and 113, respectively, and the resulting up and down hall calls are passed through dual input NAND gates 121 and 123 which have their other inputs connected to receive a system inhibit signal INHS via a NOT gate 133. If the system inhibit signal INHS is low, the up and down hall calls $\overline{1ZM}$ and $\overline{2ZM}$, respectively, are sent to the floor selectors of the elevator cars and they are multiplexed into the car status signals $\overline{DAT0}$ and $\overline{DAT1}$ via multiplexers 115 and 117, respectively, in interface 72 for transmission to the system processor 70. If the system inhibit signal INHS is high, all hall calls are blocked.

The mode select function 120 generates a true signal INH for operating a display device on the display panel 104 when the hall calls are inhibited, and also when the cars are inhibited. It also generates the true signal INHS hereinbefore referred to when the system is inhibited by blocking the up and down hall calls, and a true car inhibit signal $\overline{INHC}$ when the cars are prevented from moving. Signal $\overline{INHC}$ is sent to each car via multiplexers 101, 103, 105, and 107 in interface 72.

The data or status words $\overline{DAT0}$, $\overline{DAT1}$, $\overline{DAT2}$ and $\overline{DAT3}$ are referred to as words or signals $\overline{IN0}$, $\overline{IN1}$, $\overline{IN2}$ and $\overline{IN3}$, respectively, after they leave interface 72. These words are sent to the system processor 70, and also to the display 100. The command words $\overline{OUT0}$, $\overline{OUT1}$, $\overline{OUT2}$ and $\overline{OUT3}$ are referred to as words $\overline{COM0}$, $\overline{COM1}$, $\overline{COM2}$ and $\overline{COM3}$, respectively, after modification in interface 72, and these words are sent to the cars and also to the display 100.

Figure 2:
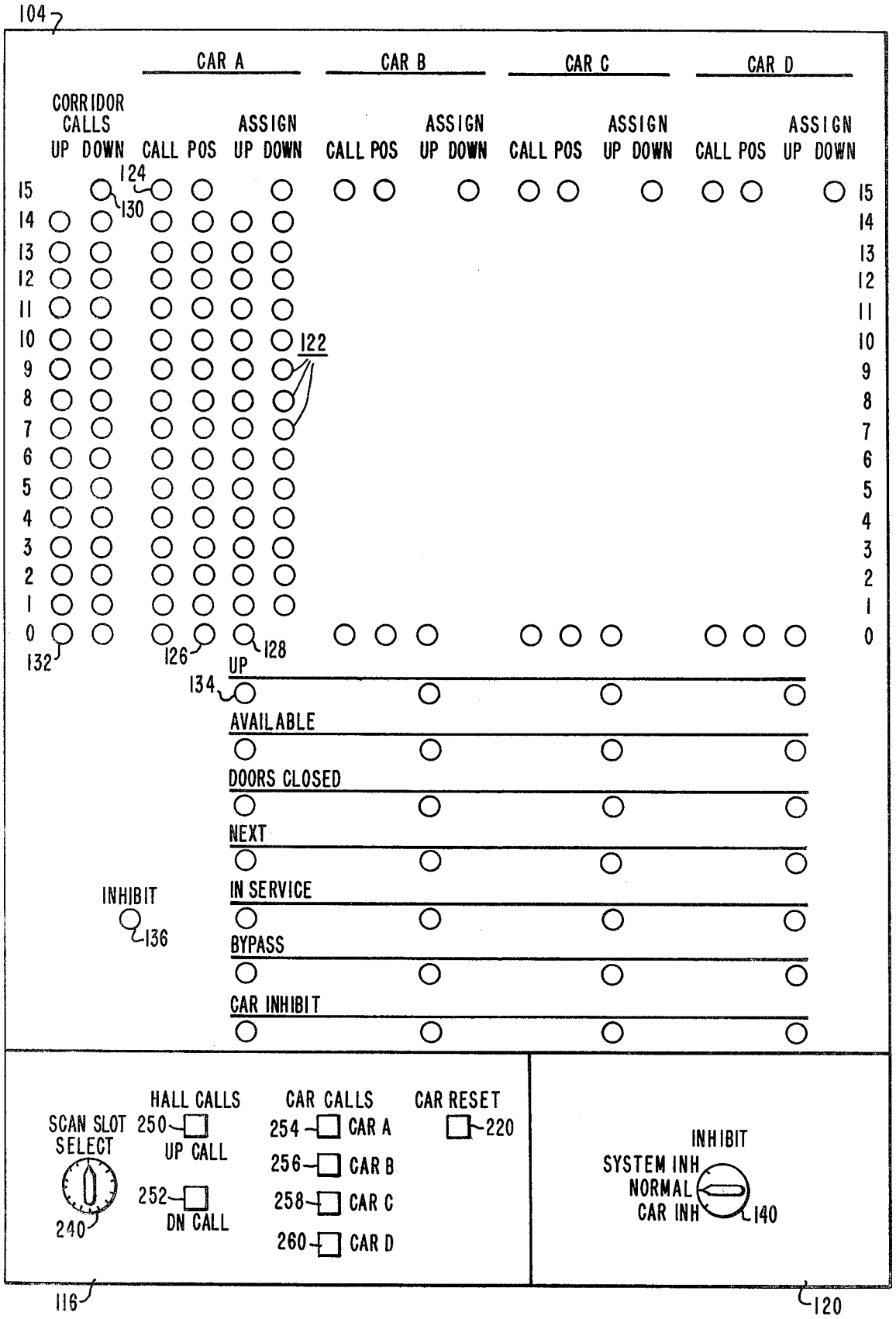
FIG. 2 is a front view of the face of a display panel shown in block form in FIG. 1.

FIG. 2 is a view of the display panel 104. Only those functions pertinent to the invention are illustrated. There are sixteen floor levels marked 0 through 15 to identify the scan slot associated with each floor level. Information for up to and including four cars is provided. Although not shown on the panel, additional groups of sixteen floors, and additional groups of four cars may be selected by appropriate selector switches on the panel. The devices shown generally at 122 which have circular configurations indicate illuminabled devices, such as lamps or LED's. Devices 122 are completely illustrated for car A, but not for the remaining cars since they would be similar. The devices having square configurations indicate pushbuttons.

The information relative to each elevator car appears in vertical columns below the legends or headings set forth on the face of the display panel which identifies the car. For example, the information relative to car A appears under the heading "Car A". Since the information for each car is similar, only the information relative to car A will be described in detail.

The vertical spacing below the heading for car A is divided into 23 rows, with the upper 16 rows pertaining to floor related information. These 16 rows are identified by the numbers 0 through 15, which would be the scan slot designations for these floors. The per floor information is divided into three categories which indicate:

1. If the car has a car call for that floor;
2. If the advanced car position is currently at that floor;
3. If this floor is included in the up and/or down assignments given to this car by the system processor.

This information appears in the first, second, third and fourth vertical columns. The first vertical column under car A, headed "Call" includes 16 illuminable devices, one for each of the 16 floor levels, such as device 124 which is energized when car A has a car call for the 16th floor (scan slot 15).

The second vertical column, i.e., the column headed "POS" includes an illuminable device for each floor level and identifies the floor of the advanced car position. For example, when car A is at the first floor (scan slot 0), device 126 will be energized. As the advanced car position changes, the devices are turned on and off to indicate the movement of the elevator car through the building. The third and fourth columns headed "ASSIGN" include two devices for each floor level except the uppermost and lowermost floors which only include one device. These devices identify the floors, and service directions therefrom, included in the assignment given to the associated car by the system processor. For example, if the up direction from the first floor (scan slot 0) is included in the assignment of car A, device 128 will be energized. The system processor of the incorporated application assigns floors and directions therefrom to the various elevator cars, whether or not there is a hall call associated with the floor at the time of the assignment.

Registered hall or corridor calls are indicated by first and second vertical columns containing illuminable devices collectively headed by the legend "Corridor Calls", and individually headed by the legends "Up" and "Dn", respectively. For example, if a down call is registered from the 16th floor (scan slot 15), device 130 will be energized, and if an up call is registered from the first floor (scan slot 0), device 132 will be energized.

The status of each car is additionally displayed relative to the legends UP, AVAILABLE, DOORS CLOSED, NEXT, IN-SERVICE, BYPASS and CAR INHIBIT. Illuminable devices relative to these legends are in the car column they are associated with. For example, if car A is set for up travel, device 134 will be energized. Certain system signals are displayed to the left of the car signals. For example, a device 136 is illuminated responsive to signal INH when any inhibits have been initiated via the mode select function 120 of the display panel 100. Additional system signals may be displayed in this location on the panel, such as indicators which indicate when the system is in up peak, down peak, through trip, and the like.

The devices associated with the call entering and storage function 116 may be located on the front of the display panel, as illustrated, or they may be located on an auxiliary control panel, as desired. For purposes of example, they are illustrated as being part of the display panel, and they will be described in detail relative to FIG. 5.

The devices associated with the mode select function 120 shown in FIG. 1 may also be incorporated into the display panel, as illustrated, or they may be mounted on an associate control. The mode select function 120 includes a mode select switch 140, which has a "normal" position, a "system inhibit" position, and a "car inhibit" position. When the switch 140 is is set in the "system inhibit" position, a true signal INHS generated which blocks up and down hall calls from being considered by the system processor 70, and it also blocks the up and down hall calls from being considered by the floor selectors of the elevator cars. This mode, when selected, enables a predetermined pattern of hall calls to be entered without action being taken by the system processor, or by the elevator cars, until the system inhibit is released.

Whend the switch 140 is set in the "car inhibit" position, the cars can "see" their assignments from the system processor, and any hall calls associated with the assignments. The cars are also able to change their status in response to assignments and hall calls, such as changing from an idle or available car to a busy car. The cars, however, are prevented from moving. In this mode, the system inhibit illuminable device 136 on the panel 104 is energized, and the devices under the legend "car inhibit", are also energized on the panel 104. Illuminable devices associated with inhibit functions may be flashed on and off to call attention to the fact that the elevator system has in some way been inhibited by actions taken on the display 100.

When the switch 140 is set in the "normal" position, all inhibits are removed. The mode select switch 140 enables new and improved servicing and maintenance methods to be utilized, which will be described in detail when the circuitry associated with the mode switch 140 is described.

Figure 3:
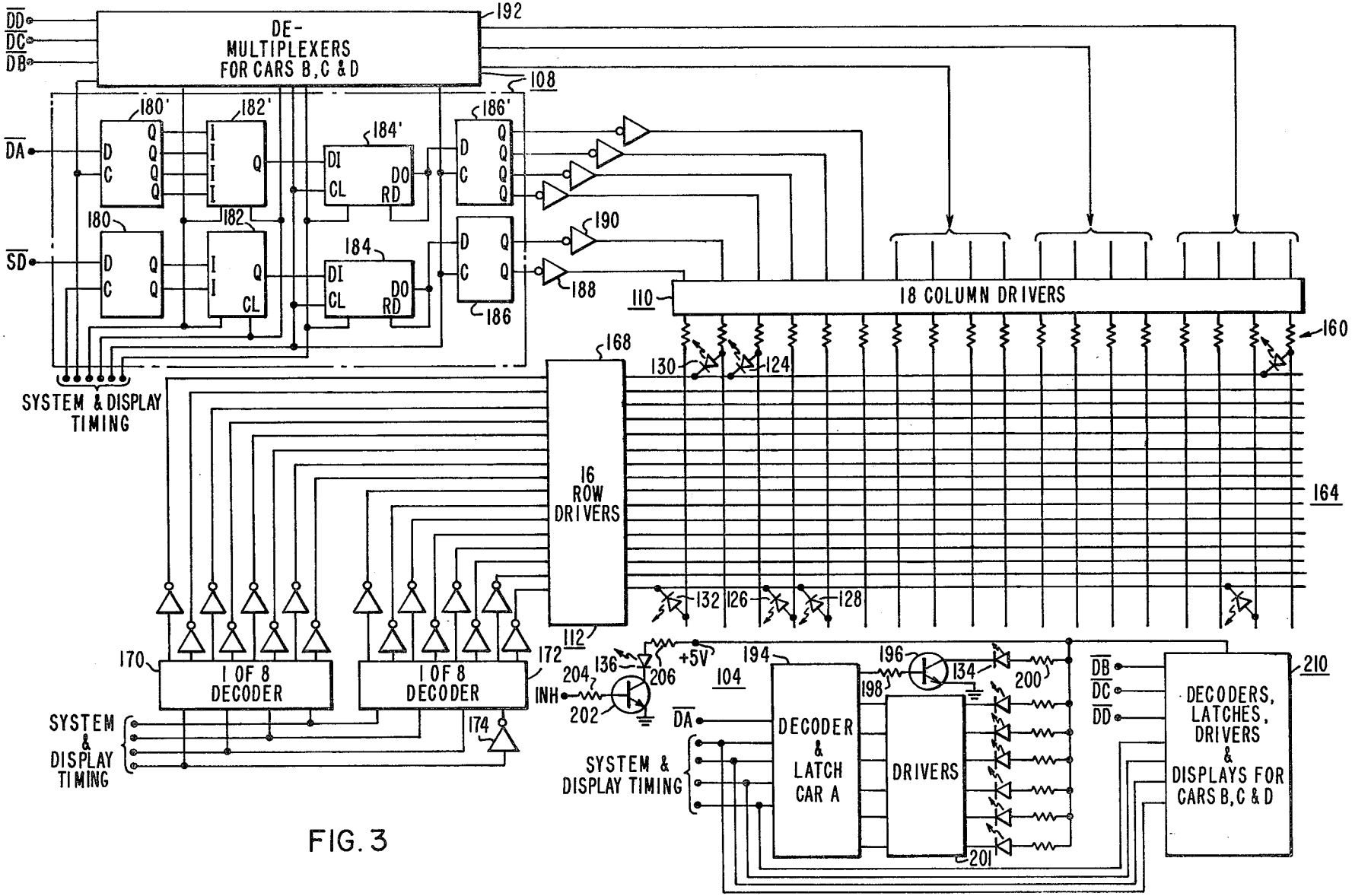
FIG. 3 is a schematic diagram of the display panel shown in FIG. 2.
Figure 4:
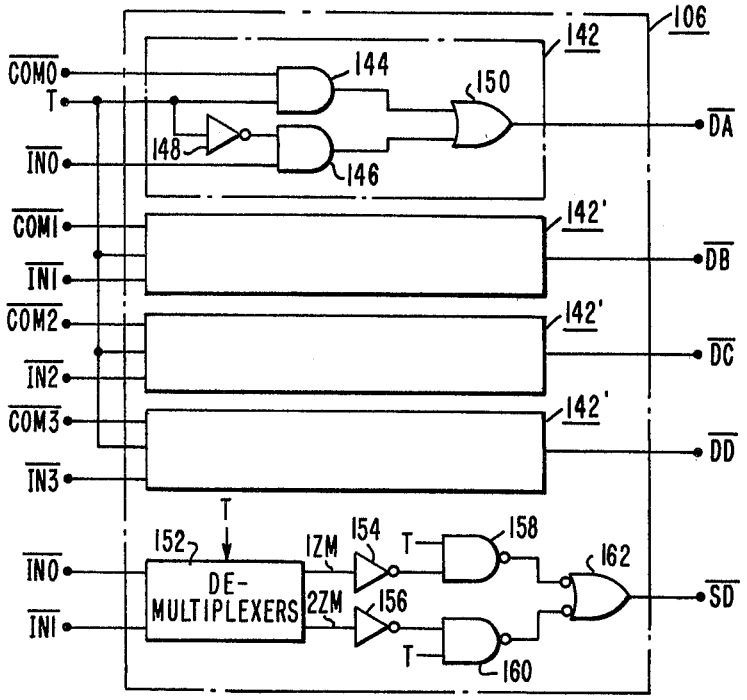
FIG. 4 is a schematic diagram illustrating how the data for the display panel may be obtained from the elevator system being serviced.

FIGS. 3 and 4 are schematic diagrams which may be combined to illustrate apparatus suitable for performing certain of the functions of display panel 100 shown in block form in FIG. 1. Specifically, FIG. 4 illustrates data select multiplexers which may be used for the multiplexer function 106 shown in FIG. 1. The data associated with car A contained in serial signals $\overline{COMO}$ and $\overline{INO}$, along with appropriate system timing signals T is combined in a logic circuit 142 to provide a single serial data signal $\overline{DA}$ relative to car A. Logic circuit 142 includes an "AND-OR Select" configuration, such as RCA's CD 4019 AD, which includes AND gates 144 and 146, and an OR gate 150. A system timing signal T is applied directly to one input of AND gate 144, and it is applied via a NOT gate 148 to one input of the other AND gate 146. Signals $\overline{COMO}$ and $\overline{INO}$ are applied to the remaining inputs of AND gates 144 and 146, respectively. The outputs of AND gates 144 and 146 are connected to the inputs of OR gate 150, and the output of OR gate 150 is connected to terminal $\overline{DA}$. The data for cars B, C and D is assembled in like manner from their associated status and command words.

Up and down hall calls $\overline{1ZM}$ and $\overline{2ZM}$ are removed from status signals $\overline{IN0}$ and $\overline{IN1}$ in multiplexers 152 and a new serial data word $\overline{SD}$ is formed. As illustrated in FIG. 4, signal $\overline{SD}$ may be formed via NOT gates 154 and 156, and NAND gates 158, 160 and 162. Up hall calls 1ZM are inverted in NOT gate 154 and applied to an input of NAND gate 158. The other input of NAND gate 158 is connected to an appropriate system timing signal T to insert the up hall calls into the desired time or scan slot. The output of NAND gate 158 is connected to an input of NAND gate 162.

Down hall calls 2ZM are inverted in NOT gate 156 and applied to an input of NAND gate 160. The other input of NAND gate 160 is connected to another system timing signal T to insert the down calls into the desired time or scan slot. The output of NAND gate 160 is connected to an input of NAND gate 162. The output of NAND gate 162 provides the serial system signal $\overline{SD}$.

FIG. 3 illustrates the demultiplexing function 108, the column drivers 110, the row drivers 112, and display panel 104. The display panel 104 includes a matrix 164 having light emitting diodes (LED's) connected between the appropriate row and column conductors of the matrix to provide the visual indications for up and down hall calls, car calls, car position, and up and down assignments for each car, as illustrated in FIG. 2. Only a few of the LED's are shown, to simplify the drawing. The devices on panel 104 shown in FIG. 2 which correspond to LED's in FIG. 3 are given the same reference numerals in FIGS. 2 and 3.

Eighteen column drivers 110 are connected to the eighteen columns of the matrix 164 via resistors 166. The row driver function 112 includes sixteen row drivers 168, and two 1 of 8 decoders 170 and 172. Display timing signals are connected to the inputs of the decoders 170 and 172, with one of the timing signals being applied directly to decoder 170, and the same timing signal is applied via a NOT gate 174 to decoder 172, in order to select one decoder for the first eight rows and the other decoder for the next eight rows. The decoders and row drivers sequentially enable the 16 rows and any active column driver will energize an LED connected between an active column and an enabled row.

The up and down hall calls for the first two columns are obtained from signal $\overline{SD}$ developed in FIG. 4. Signal $\overline{SD}$ may include additional information, if desired, such as an indication when a hall call has been registered for a predetermined period of time. This information may be used to flash the LED on and off which is associated with a timed out hall call.

Signal $\overline{SD}$ is applied to the D input of a serial input/-parallel output register 180, such as RCA's CD 4015 AD and it is clocked by a display timing signal to provide the up and down hall calls at two of its Q outputs. These outputs are applied to inputs of a parallel in/serial out shift register 182, such as RCA's CD 4021 AD. The serial output of register 182 is applied to the input of a shift register 184, such as RCA's CD 4031 which recirculates the data until updated. The output of register 184 is applied to a serial input/parallel output register 186, such as RCA's CD 4015 AD, and two of its outputs are connected to the first two columns of the matrix 164 via NOT gates 188 and 190, to indicate registered up and down hall calls, respectively.

In like manner, the data relative to car A contained in signal $\overline{DA}$, developed in FIG. 4, is applied to the next four columns of the matrix 164 with like registers associated with car A being given the same reference numerals as the registers associated with signal $\overline{SD}$, except for a prime mark.

The data relative to cars B, C and D is developed from signals $\overline{DB}$, $\overline{DC}$ and $\overline{DD}$ in a similar manner for the remaining columns, with the circuitry associated therewith being shown generally at 192. The information for the four columns associated with each car is obtained from signals $\overline{3Z}$, EQ1Z, $\overline{UPIN}$ and $\overline{DNIN}$, respectively. The per car data for car A associated with the legends UP, AVAILABLE, DOORS CLOSED, NEXT, IN-SERVICE, BYPASS, and CAR INHIBIT, is developed from signal $\overline{DA}$ via an addressable latch 194, such as RCA's CD 4099 BE. Signal $\overline{DA}$ is applied to the data input of the latch, and the latch is addressed via suitable display timing signals which are decoded by a decoder included in the addressable latch. Each output of the latch, such as the output associated with the legend UP is connected to the base of an NPN transistor 196 via a resistor 198. The LED for the legend UP associated with car A is device 134. LED 134 has its anode connected to a +5 volt source via a resistor 200 and its cathode is connected to the collector of transistor 196. The emitter of transistor 196 is connected to ground. The driver transistors for the remaining LED's associated with car A are shown generally at 201.

In like manner, the per car data for cars B, C and D is developed from signals $\overline{DB}$, $\overline{DC}$, and $\overline{DD}$, and system timing, with the decoders, latches, and display devices for cars B, C and D being shown generally at 210.

The system inhibit signal INH is connected to LED 136, with the input terminal INH being connected to the base of an NPN transistor 202 via a resistor 204. The LED has its cathode connected to the collector of transistor 202, and its anode is connected to a +5 volt source via a resistor 206.

Figure 5:
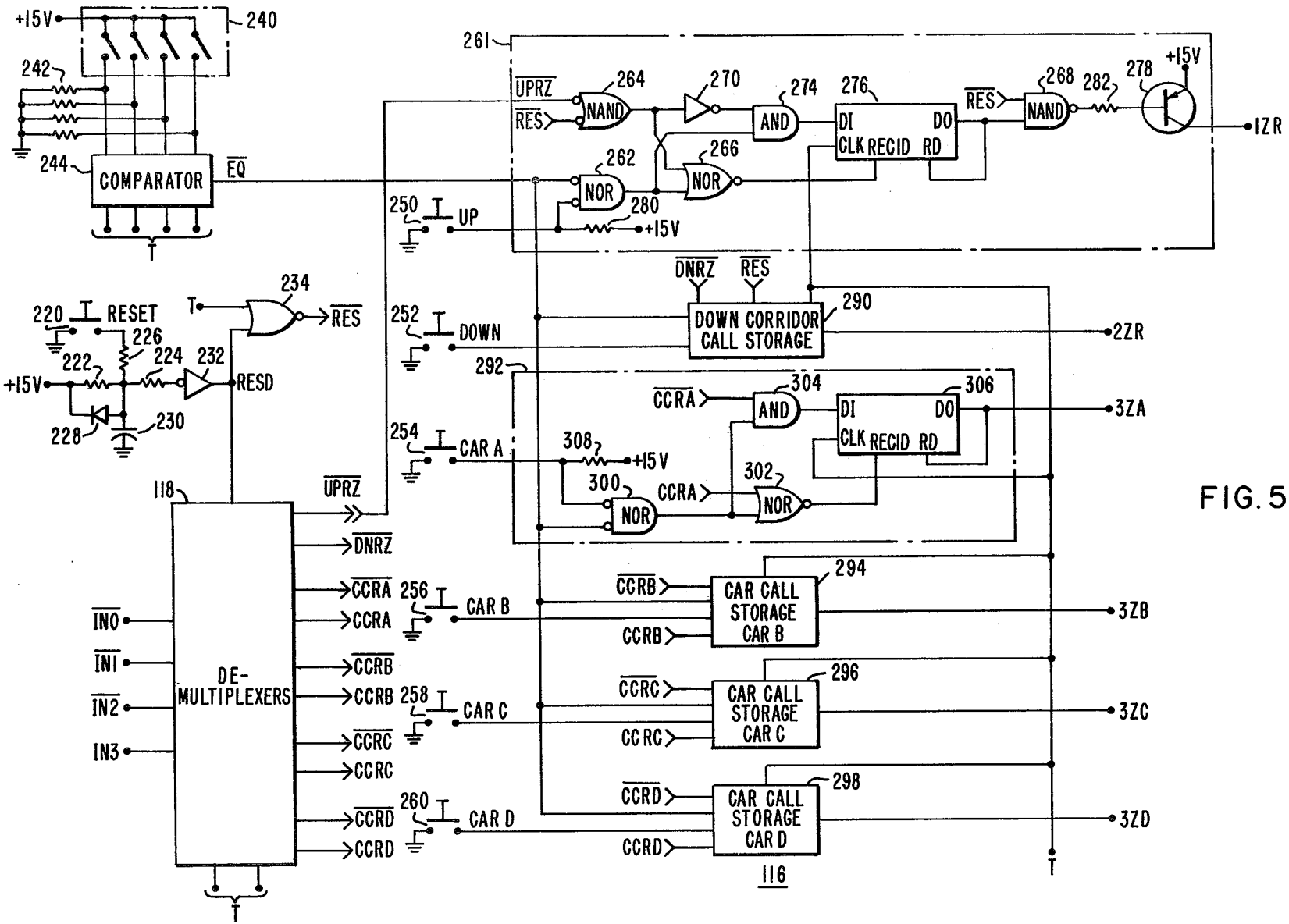
FIG. 5 is a schematic diagram which illustrates the call generation and storage function shown in block form in FIG. 1.

FIG. 5 illustrates circuitry which may be used for the demultiplexer function 118 and the call entering and storage function 116, shown in block form in FIG. 1. The demultiplexer function 118 may include a plurality of D-type flip-flops, such as RCA's CD 4013 AD, which are clocked and reset with appropriate system and display timing signals to remove the hall call and car call reset information from their scan slot positions in serial signals $\overline{IN0}$, $\overline{IN1}$, $\overline{IN2}$ and $\overline{IN3}$. The up and down hall call resets $\overline{UPRZ}$ and $\overline{DNRZ}$, and car call resets are developed by the floor selectors of the various cars when they initiate slowdown to stop at a floor to serve a registered car call, or a registered hall call. The hereinbefore mentioned U.S. Pat. No. 3,750,850 illustrates the development of such reset signals.

Display 100 includes a master reset pushbutton 220, shown in FIG. 5, and also in FIG. 2, for resetting calls initiated on the display 100. When pushbutton 220 is actuated, a signal RESD is provided which resets all car calls set on the display 100, and a signal $\overline{RES}$ is developed which resets all up and down hall calls set on the display 100. The reset function, in addition to pushbutton 220, includes a +15 volt source, resistors 222, 224, and 226, a diode 228, a capacitor 230, a NOT gate 232, and a NOR gate 234. Pushbutton 220 is serially connected between ground and a terminal RESD which provides signal RESD, via resistors 226, 224, and NOT gate 232. The junction 236 between resistors 226 and 224 is connected to the +15 volt source via resistor 222. Diode 228 is connected across resistor 222. Capacitor 230 is connected from junction 236 to ground. Thus, when pushbutton 220 is not actuated, signal RESD is low. When pushbutton 220 is actuated, signal RESD is high.

The RESD signal is applied to an input of NOR gate 234, and a system timing signal T is applied to the other input. When signal RESD goes high, it forces a true or low signal $\overline{RES}$.

To set a hall call, or a car call, the scan slot associated with the floor of the call is selected by a rotary switch 240 which includes four SPST switches. Rotary switch 240 is illustrated in FIG. 5, and also in FIG. 2. One side of each of the single pole switches is connected to a +15 volt source, and their other sides are connected to ground via resistors 242. The junctions between the resistors and the associated poles of the switches are also connected to a 4-bit magnitude comparator 244, such as RCA's CD 4063B. The output of switch 240 forms one of the input words to the comparator. The other input word is provided by the binary counter in system timing 78 which develops the scan slots. In the incorporated U.S. Pat. No. 3,804,209, for example, the scan slot timing signals which would be applied to switch 240 are identified by S0S, S1S, S2S and S3S. Thus, when a scan slot is selected on rotary switch 240, each time this scan slot is generated by system timing 78, an output signal $\overline{EQ}$ will go low for the duration of the selected scan slot.

After selecting the desired scan slot, a pushbutton associated with the call to be entered is actuated, which then enters the call into the system. Up and down hall calls are entered via pushbuttons 250 and 252, respectively, and car calls for cars A, B, C and D are entered via pushbuttons 254, 256, 258 and 260, respectively. These pushbuttons are illustrated in FIG. 5, and also in FIG. 2.

The circuitry associated with the setting of the up hall calls, shown generally within block 261, includes NOR gates 262 and 266, NAND gates 264 and 268, a NOT gate 270, an AND gate 274, a shift register 276, such as RCA's CD 4031, and a PNP transistor 278. The up pushbutton 250 is connected between ground and a +15 volt source via a resistor 280. One input of NOR gate 262 is connected to the pushbutton 250 such that it is high when the pushbutton is not actuated, and low when it is actuated. The other input of NOR gate 262 is connected to receive signal $\overline{EQ}$ from comparator 244. The output of NOR gate 262 is normally low. When pushbutton 250 is actuated to enter an up hall call, the output of NOR gate 262 will go high during the scan slot selected by switch 240. The output of NOR gate 262 is connected to an input of AND gate 274, which has its output connected to the data input of shift register 276. The output of NOR gate 262 is also connected to the recirculating mode control input via NOR gate 266. A high input to this mode control input of the shift register recirculates the data applied to the RD input from the DO output of the register. A low input, on the other hand, does not recirculate the output. Shift register 276 is clocked by a suitable system timing signal.

The remaining input of AND gate 274, and the remaining input of NOR gate 266 is connected to receive call reset signals. Up call reset signal $\overline{UPRZ}$ and the master call reset signal $\overline{RES}$ are applied to the two inputs of NAND gate 264. The output of NAND gate 264 is applied to AND gate 274 via NOT gate 270, and it is also applied directly to an input of NOR gate 266.

When no resets are true, NAND gate 264 outputs a zero and enables AND gate 274 via the NOT gate 270 to pass a high signal from NOR gate 262 into the data input of the shift register. The zero output of NAND gate 264, along with the normally zero output of NOR gate 262, causes NOR gate 266 to apply a logic one to the mode control input of shift register 276, which recirculates the data.

Thus, when pushbutton 250 is actuated to place an up call from the floor associated with the scan slot selected by rotary switch 240, the high signal from NOR gate 262 during the appropriate scan slot causes the data for this scan slot to be entered via the DI input, rather than through the RD input. Thus, the call is entered and stored in in the recirculating shift register. When this call is answered, signal $\overline{UPRZ}$ will go low during the scan slot associated with the call floor, forcing AND gate 274 to output a zero during this scan slot, which zero is loaded into the shift register because the mode control input will now be low to shift the data at the DI input into this scan slot, rather than the data which appears at the RD input. Thus, the call is erased from the shift register or memory 276. A true $\overline{RES}$ signal will clear all calls from shift register 276 as it will be true during all of the scan slots.

The data appearing at the DO output of shift register 276 is applied to one input of NAND gate 268, and the master reset signal RES is applied to the other input, to insure that all up hall calls are reset when the reset button 220 is actuated. The output of NAND gate 268 is applied to the base of transistor 278 via a resistor 282. The emitter of transistor 278 is connected to a +15 volt source, and the collector provides the serial up call signal 1ZR, which contains all up hall calls set on panel 100.

Down hall calls 2ZR are set in a manner similar to the up hall calls 1ZR, with the exception that the down hall call pushbutton 252 is used, and the down hall call reset signal $\overline{DNRZ}$ is used instead of the up hall call reset signal $\overline{UPRZ}$. The circuitry associated with the down hall call function is thus shown generally at 290.

The circuitry for registering a car call for car A is shown within block 292. The circuitry for registering car calls for cars B, C, and D is shown generally as blocks 294, 296 and 298, since the circuitry for these cars may be similar to that shown for car A within block 292.

More specifically, function 292 includes NOR gates 300 and 302, an AND gate 304, and a shift register 306, such as RCA's CD 4031. Pushbutton 254 is connected between ground and a +15 volt source via a resistor 308. One input of NOR gate 300 is connected to receive signal $\overline{EQ}$ and the other input is connected to pushbutton 254 such that this input will be high unless pushbutton 254 is actuated. Thus, NOR gate 300 normally outputs a logic zero. When pushbutton 254 is actuated, NOR gate 300 will output a logic one during the scan slot selected by switch 240. The output of NOR gate 300 is applied to one input of AND gate 304, and the other input of AND gate 304 is connected to receive reset signal $\overline{CCRA}$ from the demultiplexer 118. The output of AND gate 304 is connected to the data input DI of shift register 306.

The output of NOR gate 300 is also connected to one input of NOR gate 302. The other input of NOR gate 302 is connected to receive reset signal CCRA. The output of NOR gate 302 is connected to the mode control input of shift register 306. The output DO of shift register 306 is connected to the recirculate data input RD, and to output terminal 3ZA which provides serial car calls for car A which are set on panel 100. The function of entering calls, and resetting or erasing the calls in the shift register, which functions as the car call storage memory, is the same as described relative to up hall calls.

Figure 6:
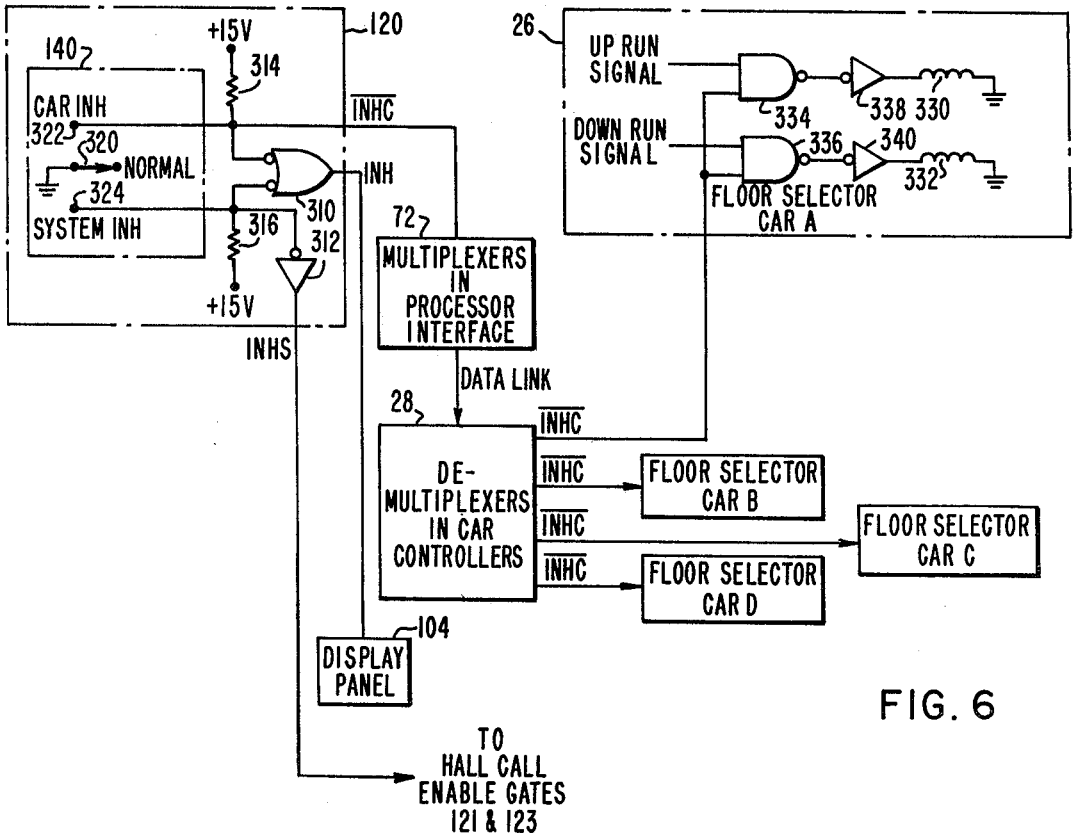
FIG. 6 is a schematic diagram which illustrates the car inhibit function shown in block form in FIG. 1.

FIG. 6 is a schematic diagram which illustrates an exemplary implementation of the mode select function 120 shown in block form in FIG. 1. The mode select function 120 includes the selector switch 140 shown in FIG. 1, a NAND gate 310, a NOT gate 312, and resistors 314 and 316. The switch 140 includes a selector arm 320 connected to ground and three positions for the selector arm. One of the positions, entitled "car inhibit" includes a terminal 322 which is connected to a +15 volt source via resistor 314. Terminal 322 is also connected to an input of NAND gate 310.

Another of the positions, entitled "system inhibit", includes a terminal 324 which is connected to a +15 volt source via resistor 316. Terminal 324 is also connected to an input of NAND gate 310, and to the input of NOT gate 312.

The remaining position, entitled "Normal" results in the grounded selector arm 320 being in a neutral position where it is not connected to either terminal 322 or terminal 324.

When selector arm 320 is in the "normal" position, terminal 322 is high, providing a high car inhibit signal $\overline{INHC}$ for the multiplexers of interface 72, as illustrated in FIG. 1. Terminal 324 is also high, providing a low system inhibit signal INHS via gate 312, which signal is used to control the enable gates 121 and 123 associated with up and down hall call signals $\overline{1ZM}$ and $\overline{2ZM}$, as shown in FIG. 1. NAND gate 310 outputs a low signal INH, and thus device 136 on the display panel 104, shown in FIGS. 2 and 3, is deenergized.

Signal $\overline{INHC}$ is applied to each of the floor selectors. FIG. 6 illustrates how it may be connected in floor selector 26 associated with car A. Floor selector 26 includes an up run relay 330 and a down run relay 332. Normally, an "up run" signal generated in the floor selector goes high to energize the up run relay 330 to cause the car to run in the up direction, and a "down run" signal goes high to energize the down run relay 332 to cause the car to run in the down direction. NAND gates 334 and 336, and NOT gates 338 and 340 are provided to block these "run" signals from their associated relays when signal $\overline{INHC}$ is low. The car inhibit signal $\overline{INHC}$ is applied to an input of each NAND gate 334 and 336. The up run signal is connected to the remaining input of NAND gate 334, and the down run signal is connected to the remaining input of NAND gate 336. The output of NAND gate 334 is connected to relay 330 via NOT gate 338, and the other side of relay 330 is connected to ground. The output of NAND gate 336 is connected to relay 332 via NOT gate 340, and the other side of relay 332 is connected to ground. When the selector arm 320 is not set to the car inhibit position, signal $\overline{INHC}$ is high, enabling NAND gates 334 and 336 to pass the associated run signals to the associated running relay. When selector arm 320 is set to the car inhibit position, signal $\overline{INHC}$ goes low and the associated car, if stopped, will not run, as the up run and down run signals are both blocked. If the car is running at the time signal $\overline{INHC}$ goes low, it will continue to run until it makes a normal stop. Relays 330 and 332 cause an auxiliary run relay to pick up when they are energized, which remains energized until the car stops at a floor. Once the car stops it will not restart with signal $\overline{INHC}$ low.

When the selector arm is not in the system inhibit position, signal INHS is low, which is inverted by NOT gate 133 in FIG. 1 to enable the up and down hall call gates 121 and 123, respectively. These gates are illustrated in FIG. 1. When the selector arm is actuated to the system inhibit position, signal INHS goes high and NOT gate 133 shown in FIG. 1 inverts the signal to block hall calls from passing through gates 121 and 123.

When selector arm 320 is in either the car inhibit position, or the system inhibit position, the output of NAND gate 310 is high, providing a true or high signal, INH which energizes LED 136 shown in FIGS. 2 and 3 to indicate that an inhibit mode has been selected.

In servicing an elevator system having a plug-in receptacle adapted to receive the connector 102 shown in FIG. 1, the portable panel position and motion indicator 100 is simply plugged into the interface 72 and the positions of the cars in the building, the positions of registered car calls and hall calls, and selected status signals for the elevator cars, are all immediately displayed. Car calls and hall calls may be entered via display 100, and the system response thereto observed. If the response of the elevator system to a predetermined block of hall calls is desired, the system inhibit mode is selected by switch 140. This allows any number of hall calls to be entered without response by the system processor, or response by the cars. After the predetermined pattern of hall calls has been entered, actuating switch 140 to the normal position will elicit response from the system processor and the cars, which may be observed. The cars may initially be sent to predetermined floors of the building simply by registering car calls on the panel for these floors.

The system processor and cars may be given a more thorough check without the confusion of lights flashing on and off all over the panel by selecting the car inhibit mode. This mode maintains everything in the system operational, except it prevents the cars from moving. This arrangement has been found to be a highly effective servicing method. Prior to inhibiting the cars, they may be sent to predetermined floors by setting car calls for these floors on the display. The cars are then inhibited. Calls may be entered one at a time, and after each call has been entered, the response of the system processor may be observed by checking the assignments that it makes to the cars, and the responses of the car controllers of the various cars may be observed by checking the car status indicators, to note their response to such assignments. Since the elevator cars cannot move in response to a call which has been entered, the display panel 104, once it indicates the system response, remains static, permitting detailed evaluation of the response and comparison with the desired response. This comparison may be provided for maintenance personnel in the form of a chart which may be immediately and easily compared with the actual response on the display panel. Failure to respond properly pinpoints the portion of the elevator system which is malfunctioning. Malfunctions in system strategies which would be almost impossible to detect in a dynamic system, i.e., one in which the cars are permitted to respond, are easily and quickly checked by the new servicing tool and methods of the invention.

We claim as our invention:

1. A method of servicing an elevator system which includes a plurality of elevator cars mounted in a building, and a supervisory system processor which makes assignments to the elevator cars responsive to system conditions and a predetermined strategy, comprising the steps of:

providing a visual display which displays the assignments made to the cars by the system processor, providing means for selectively entering calls for elevator service, inhibiting the elevator cars from moving, entering a call for elevator service, and observing the assignments made to the cars by the system processor.

2. The method of claim 1 including the steps of providing a correct assignment pattern for the call entered, and comparing the correct assignment pattern with the actual assignment pattern displayed on the visual display.

3. The method of claim 1 including the steps of entering sequentially a plurality of predetermined calls for elevator service, and observing the assignments made to the cars by the system processor on the visual display after each call is entered.

4. The method of claim 1 including the steps of providing the correct assignment pattern for each call entry, and comparing each correct assignment pattern with the actual assignment pattern displayed on the visual display.

5. The method of claim 1 including the step of sending each elevator car to a predetermined floor prior to the inhibiting step.

6. The method of claim 1 including the steps of sending each elevator car to a predetermined floor prior to the inhibiting step, entering sequentially a plurality of predetermined calls for elevator service, and observing the assignments made to the cars by the system processor on the visual display as each call is entered.

7. The method of claim 6 including the steps of providing the correct assignment pattern for each call entry, and comparing each correct assignment pattern with the actual assignment pattern displayed on the visual display.

8. The method of claim 1 including the steps of storing calls entered by the means provided to selectively enter calls, separately from calls entered by the call means associated with the elevator system, and OR'ing the calls entered by the means provided to selectively enter calls, with the calls entered by the call means associated with the elevator system.

9. A method of servicing an elevator system which includes a plurality of elevator cars mounted in a building to serve the floors therein, a supervisory system processor which makes assignments to the cars responsive to system conditions and a predetermined strategy, call entering means for entering calls for elevator service, and memory means for storing calls for elevator service until they are answered, comprising the steps of:

providing a visual display which displays the positions of the elevator cars in the building, and the locations of calls for elevator service in the building, providing auxiliary call entering means separate from the call entering means associated with the elevator system, providing auxiliary memory means separate from the memory means associated with the elevator system, and OR'ing the calls stored in the two separate memory means to provide a composite signal which includes calls from both memory means.

10. A method of servicing an elevator system which includes a plurality of elevator cars mounted in a building, and a supervisory system processor which makes assignments to the elevator cars responsive to system conditions and a predetermined strategy, comprising the steps of:

providing a visual display which displays assignments made to the cars by the system processor, the locations of the cars in the building, the locations of calls for elevator service and signals which indicate the status of each of the elevator cars, providing means adjacent to the visual display for selectively entering calls for elevator service, inhibiting the elevator cars from moving, entering a call for elevator service, and observing the assignments made to the cars by system processor, and the status signals relative to the cars.

11. The method of claim 10 including the steps of providing a correct assignment and status pattern for the call entered, and comparing the correct assignment and car status pattern with the actual assignment and car status pattern displayed on the visual display.

12. The method of claim 10 including the steps of entering sequentially a plurality of predetermined calls for elevator service, observing the assignments made to the cars by the system processor on the visual display after each call is entered, and observing the car status signals relative to the cars after each call is entered.

13. The method of claim 12 including the steps of providing the correct assignment and car status pattern for each call entry, and comparing each correct assignment and car status pattern with the actual assignment and car status pattern displayed on the visual display.

14. The method of claim 10 including the step of sending each elevator car to a predetermined floor prior to the inhibiting step.

15. The method of claim 10 including the steps of sending each elevator car to a predetermined floor prior to the inhibiting step, entering sequentially a plurality of predetermined calls for elevator service, observing the assignments made to the cars by the system processor on the visual display after each call is entered, and observing the car status signals relative to the cars on the visual display after each call is entered.

16. The method of claim 14 including the steps of providing the correct assignment and car status pattern for each call entry, and comparing each correct assignment and car status pattern with the actual assignment and car status pattern displayed on the visual display.

17. The method of claim 10 including the steps of storing calls entered by the means provided to selectively enter calls, separately from calls entered by the call means associated with the elevator system, and OR'ing the calls entered by the means provided to selectively enter calls, with the calls entered by the call means associated with the elevator system.

18. A servicing tool for servicing an elevator system having a plurality of cars mounted in a building to serve the floors therein, conventional call means for entering calls for elevator service, and a supervisory system processor which makes assignments to the elevator cars responsive to system conditions and a predetermined strategy, comprising:

a visual display for displaying assignments to the cars by the system processor, and the positions of the elevator cars in the building, call entering means for selectively entering calls for elevator service remote from the conventional call means, and inhibit means for inhibiting the elevator cars from moving, wherein assignments to the cars by the supervisory system processor in response to calls entered on said call entering means may be observed on the visual display.

19. The servicing tool of claim 18 wherein the visual display includes means for displaying signals relative to the status of each of the elevator cars, and the inhibit means prevents the cars from moving while maintaining the ability of the cars to otherwise respond to assignments and calls for elevator service and to prepare status signals in response thereto.

20. The servicing tool of claim 18 including means for storing the remotely entered calls entered by the call entry means separately from the calls entered by the call means associated with the elevator system, and means OR'ing remotely entered calls with conventionally entered calls.

* * * * *